US010798489B2

(12) United States Patent
Chen

(10) Patent No.: US 10,798,489 B2
(45) Date of Patent: Oct. 6, 2020

(54) ARRAY TYPE MAGNETIC CIRCUIT SYSTEM

(71) Applicant: Tymphany Acoustic Technology (Huizhou) Co., Ltd., Huizhou, Guangdong Province (CN)

(72) Inventor: Zhi Chen, Huizhou (CN)

(73) Assignee: Tymphany Acoustic Technology (Huizhou) Co., Ltd., Huizhou, Guangdong Prov. (CN)

( * ) Notice: Subject to any disclaimer, the term of this patent is extended or adjusted under 35 U.S.C. 154(b) by 0 days.

(21) Appl. No.: 16/536,023

(22) Filed: Aug. 8, 2019

(65) Prior Publication Data

US 2020/0059727 A1 Feb. 20, 2020

(30) Foreign Application Priority Data

Aug. 14, 2018 (CN) ..... 2018 2 1302082 U

(51) Int. Cl.
*H04R 9/02* (2006.01)
*H04R 9/06* (2006.01)

(52) U.S. Cl.
CPC ..... *H04R 9/025* (2013.01); *H04R 9/06* (2013.01)

(58) Field of Classification Search
CPC ..... H04R 9/025; H04R 9/06
USPC ..... 381/421
See application file for complete search history.

(56) References Cited

U.S. PATENT DOCUMENTS

| | | | | |
|---|---|---|---|---|
| 6,404,896 | B1 * | 6/2002 | Yoo | H04R 9/045 381/401 |
| 2005/0041831 | A1 * | 2/2005 | Stiles | H04R 9/022 381/412 |
| 2007/0098209 | A1 * | 5/2007 | Setiabudi | H04R 9/063 381/420 |
| 2011/0007913 | A1 * | 1/2011 | Nielsen | H04R 9/025 381/185 |
| 2011/0235848 | A1 * | 9/2011 | Meguro | H04R 7/045 381/400 |
| 2014/0054981 | A1 * | 2/2014 | Huang | H04R 7/18 310/25 |

FOREIGN PATENT DOCUMENTS

| | | |
|---|---|---|
| CN | 206611574 U | 11/2017 |
| CN | 207039884 U | 2/2018 |

* cited by examiner

*Primary Examiner* — Sean H Nguyen
(74) *Attorney, Agent, or Firm* — Muncy, Geissler, Olds & Lowe, P.C.

(57) ABSTRACT

An array type magnetic circuit system includes a T yoke, magnetic steels and a washer. The T yoke includes a bottom plate, and more than two central columns located on the bottom plate and distributed in an array. The magnetic steels are respectively disposed at two sides of each of the central columns and provide a magnetic energy for the magnetic circuit system. Hole positions coupled with the central columns correspondingly are formed on the washer and the washer is tightly connected to the T yoke. According to the array type magnetic circuit system, under a condition in which a plurality of magnetic circuits are combined, the T yoke and the washer are respectively taken as a component, so that the precision of a product can be controlled better.

6 Claims, 4 Drawing Sheets

ARRAY TYPE MAGNETIC CIRCUIT SYSTEM

CROSS REFERENCE TO RELATED APPLICATIONS

This application claims priority of Application No. CN 201821302082.5 filed in China on Aug. 14, 2018 under 35 U.S.C. § 119, the entire contents of all of which are hereby incorporated by reference.

TECHNICAL FIELD

This invention relates to the technical field of loudspeaker magnetic circuits, and in particular to an array type magnetic circuit system.

BACKGROUND

In a conventional magnetic circuit system of a rectangular loudspeaker, a common circular magnetic circuit system often used in the industry at present includes an internal magnetic circuit and an external magnetic circuit. The internal magnetic circuit and the external magnetic circuit are further arranged simply together to form a dual magnetic circuit system.

In addition, when the rectangular loudspeaker is designed, one magnetic circuit or a combination of two magnetic circuits is often used. When the loudspeaker is longer, a combination of more magnetic circuits may be required. When a thickness of the loudspeaker needs to be controlled, an internal magnetic structure is adopted and a square magnet is adopted by an external magnetic structure. In this way, it may be assured that magnetic circuits do not exceed the overall thickness of the loudspeaker.

However, in a production process of the loudspeaker combined with a plurality of magnetic circuits, the process is complex and the production cost is also increased. For example, in the design of a ferrite loudspeaker, a distance between a plurality of voice coils is also very wide, so that the rigidity of drum paper is highly demanding.

Therefore, it is necessary to optimally design the existing magnetic circuit structure system to meet the manufacturing requirement of a long loudspeaker.

SUMMARY

In order to solve the above problem in the prior art, the present invention provides an array type magnetic circuit system. Under a condition in which a plurality of magnetic circuits are combined, a T yoke and a washer are respectively taken as a component, so that the precision of a product can be controlled better. Meanwhile, by utilizing the array type magnetic circuit system formed by the T yoke, magnetic steels and the washer, the flux leakage may be better controlled, and the utilization efficiency for the performance of the magnetic steels is improved.

To this end, the application provides the following technical solutions.

An array type magnetic circuit system includes a T yoke, magnetic steels and a washer; and the T yoke includes a bottom plate, and more than two central columns located on the bottom plate and distributed in an array.

The magnetic steels are respectively disposed at two sides of each of the central columns and provide a magnetic energy for the magnetic circuit system.

Hole positions coupled with the central columns correspondingly are formed on the washer.

The washer is tightly connected to the T yoke.

In the array type magnetic circuit system provided by the application, the more than two central columns are distributed on the bottom plate of the T yoke in the array; the magnetic steels are respectively located at the two sides of each of the central columns, i.e., the magnetic steels are respectively disposed at the two sides of each of the central columns. Meanwhile, the hole positions corresponding to the central columns are formed on the washer, thus being coupled with the T yoke. According to the array type magnetic circuit system, by forming a plurality of magnetic circuit systems on one T yoke and one washer, the good application of a combination of the magnetic circuit systems of a rectangular loudspeaker is guaranteed.

As a further description of the technical solutions of this application, the central columns are distributed on the bottom plate of the T yoke in a linear array, a rectangular array or an annular array. According to the requirement of the magnetic circuit combination, the central columns of the T yoke may be designed into a linear shape, a rectangular shape or an annular shape to meet the requirement of the application.

As a further description of the technical solutions of the application, the central columns and the bottom plate are of an integral structure or a split structure.

As a further description of the technical solutions of the application, each of the magnetic steels is of a cylindrical shape, a square shape or an annular shape.

As a further description of the technical solutions of the application, each of the magnetic steels is an iron-rubidium-boron magnet.

The application further provides a loudspeaker including the above array type magnetic circuit system.

Based on the above technical solutions, the application achieves the following technical effects:

1. the precision of the product may be controlled better;
2. the working procedures are simplified; and
3. the production cost of the product is reduced.

Besides, through utilizing the loudspeaker including the array type magnetic circuit system, the flux leakage may be better controlled, and the utilization performance of the magnetic steels is improved.

NUMERALS IN THE DRAWINGS

| | | | | | |
|---|---|---|---|---|---|
| 1 | T yoke | 11 | bottom plate | 12 | central column |
| 2 | magnetic steel | 3 | washer | 31 | hole position |

DETAILED DESCRIPTION

In order to understand the application conveniently, the application will be described more throughly in conjunction with the accompanying drawings and specific embodiments. Preferred implementation manners of the application are given in the accompanying drawings. However, the application may be implemented in many different forms and is not limited to the implementation manners described herein. Reversely, the purpose of providing these implementation manners is to understand the contents of the application more throughly and comprehensively.

It is to be noted that when an element is referred to as being "fixed on" another element, it may be directly on the other element or an intervening element may also be present. When one element is considered as being "connected to" the other element, it may be directly connected to the other element or an intervening element may also be present.

For the ease of reading, the "upper", "lower", "left" and "right" indicated according to the accompanying drawings are merely for indicating a relative reference position of each element and are not intended to limit the present invention.

Unless otherwise defined, all technical and scientific terms used herein have the same meaning as commonly understood by a person skilled in the art to which the application belongs. Terms used herein in the specification of the application are merely for describing the specific implementation manners but are not intended to limit the application.

Embodiment 1

Figure 1:
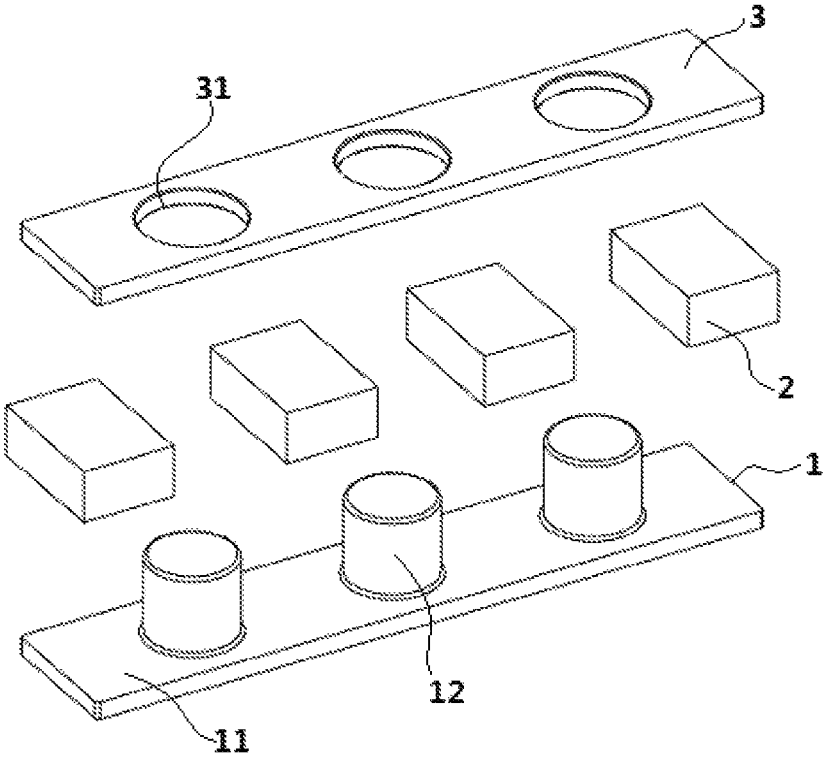
FIG. 1 is an exploded view of an array type magnetic circuit system in an embodiment of the application.
Figure 2:
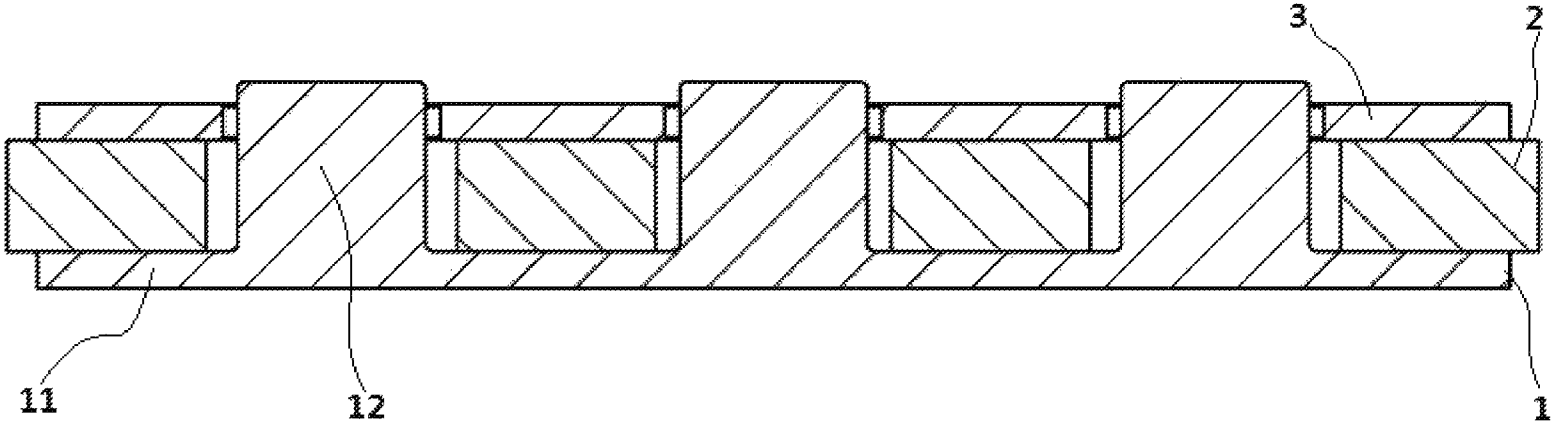
FIG. 2 is a sectional view of an array type magnetic circuit system in an embodiment of the application.

FIG. 1 and FIG. 2 respectively illustrate an exploded view and a sectional view of an embodiment of the application. As shown in FIG. 1 and FIG. 2, an array type magnetic circuit system includes a T yoke 1, magnetic steels 2 and a washer 3 from the bottom up. The T yoke 1 includes a bottom plate 11, and a plurality of central columns 12 located on the bottom plate 11. In the embodiment illustrated in FIG. 1 and FIG. 2, the T yoke 1 includes more than two central columns 12 located on the bottom plate 11. According to the arrangement of the structure, the bottom plate 11 and the central columns 12 may be of an integral structure and may also be of a split structure, but the T yoke is a whole component. More than two central columns 12 are provided. In this embodiment, three central columns 12 are provided and are distributed on the bottom plate in a linear array. It is to be noted that the central columns 12 may also be arranged into a rectangular array and an annular array according to requirements of a magnetic circuit system.

The magnetic steels 2 are respectively disposed at two sides of each of the central columns 12. The magnetic steels provide a magnetic energy for the magnetic circuit system. In this embodiment, each of the magnetic steels 2 is a square magnetic steel and is made of an iron-rubidium-boron magnet. Certainly, each of the magnetic steels may also be a cylindrical magnetic steel or an annular magnetic steel according to requirements of a structural design and a magnetic circuit system design. When the magnetic steels are the annular magnetic steels, the magnetic steels are sleeved into the central columns. The magnetic steels are also located on the bottom plate 11 and are arranged at intervals with the central columns 12.

The washer 3 is disposed on the magnetic steels 2 and the central columns 12. Similar to the T yoke, the washer 3 is also a whole component. Meanwhile, the washer 3 is provided with hole positions 31 to be coupled with the central columns 12 correspondingly. Further, the washer 3 is tightly coupled to the T yoke 1.

Figure 3:
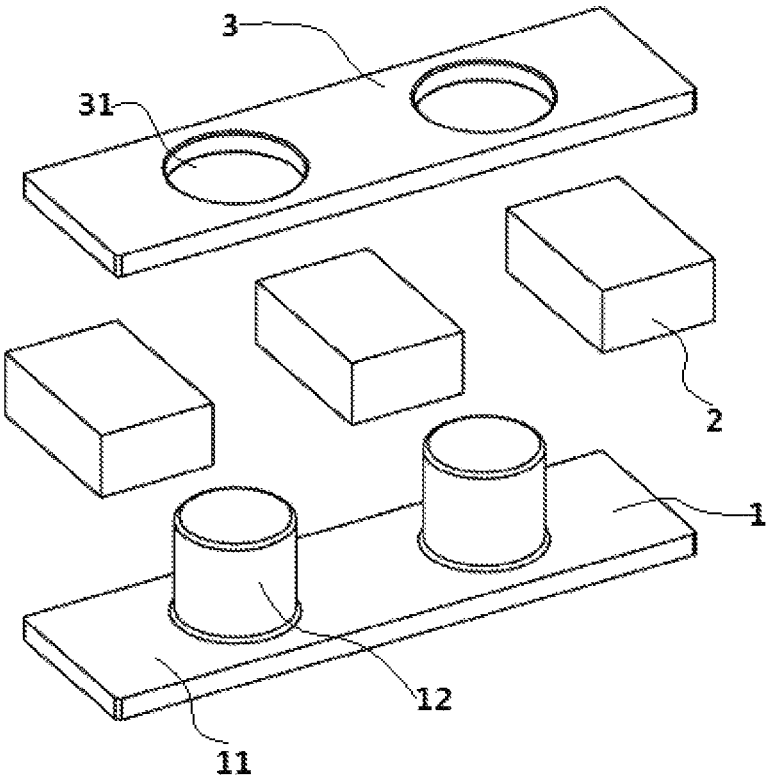
FIG. 3 is an exploded view of an array type magnetic circuit system in another embodiment of the application.
Figure 4:
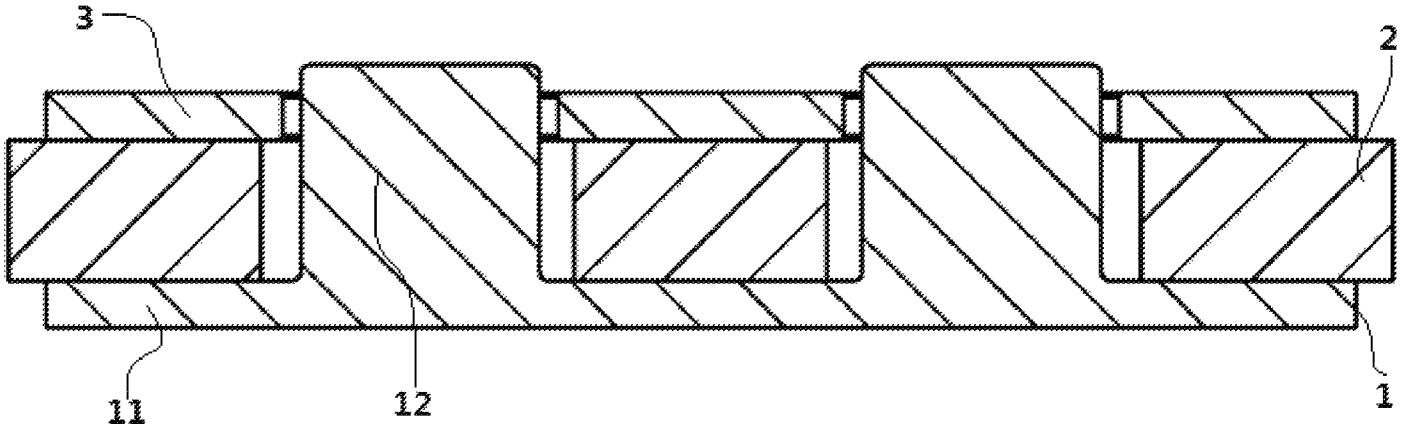
FIG. 4 is a sectional view of an array type magnetic circuit system in another embodiment of the application.

FIG. 3 and FIG. 4 respectively illustrate an exploded view and a sectional view of another embodiment of the application. As shown in FIG. 1 and FIG. 2, for the array type magnetic circuit system in this embodiment, two central columns 12 are disposed on the T yoke 1 and, correspondingly, two hole positions are provided on the washer 3.

In the embodiments provided by the application, the central columns distributed in the array are disposed on the T yoke and are coupled with the magnetic steels and the washer, so that a combination of a plurality of magnetic circuit systems can be formed on a single T yoke component and a single washer component. Therefore, the precision of the product may be controlled better, the working procedures are simplified and thus the production cost of the product is reduced. By utilizing the loudspeaker including the array type magnetic circuit system, the flux leakage may be better controlled, and the utilization performance of the magnetic steels is improved.

The above contents are merely examples and explanations for the structure of the application, and the description is specific and detailed but cannot be understood as a limit to the patent scope of the application thereto. It is to be noted that those of ordinary skill in the art may further make a plurality of variations and improvements without departing from the concept of the application and these obvious replacement forms all pertain to the protection scope of the application.

The invention claimed is:

1. An array type magnetic circuit system, comprising:
- a T yoke, comprising:
  - a bottom plate; and
  - more than two central columns located on the bottom plate and distributed in an array;
- magnetic respectively disposed at two sides of each of the more than two central columns; and
- a washer having hole positions, coupled with the central columns, correspondingly formed on the washer,
- wherein the washer is connected to the T yoke.

2. The array type magnetic circuit system according to claim 1, wherein the central columns are distributed on the bottom plate of the T yoke in a linear array, a rectangular array or an annular array.

3. The array type magnetic circuit system according to claim 2, wherein the central columns and the bottom plate are of an integral structure or a split structure.

4. The array type magnetic circuit system according to claim 1, wherein each of the magnetic steels is of a cylindrical shape, a square shape or an annular shape.

5. The array type magnetic circuit system according to claim 1, wherein each of the magnetic steels is an iron-rubidium-boron magnet.

6. A loudspeaker comprising the array type magnetic circuit system according to claim 1.

* * * * *